United States Patent [19]

Nakamura

[11] Patent Number: 4,775,264

[45] Date of Patent: Oct. 4, 1988

[54] CORNER BLOCK UNIT FOR MASONRY WALL STRUCTURE

[76] Inventor: Moritoshi Nakamura, c/o Cosmo Real Estate Company, Limited, No. 4-10, 4-chome, Ginza, Chuo-ku, Tokyo, Japan

[21] Appl. No.: 66,982

[22] Filed: Jun. 29, 1987

[51] Int. Cl.[4] ..... E02D 27/00; E02B 3/12; E04B 1/00

[52] U.S. Cl. ..... 405/16; 52/275

[58] Field of Search ..... 52/275, 277, 280, 288, 52/272, 596, 656; 405/16, 17, 19, 20

[56] References Cited

U.S. PATENT DOCUMENTS

| | | | |
|---|---|---|---|
| 3,304,673 | 2/1967 | Ramoneda | 52/275 |
| 3,386,252 | 6/1968 | Nelson | 405/20 |
| 4,091,585 | 5/1978 | Rudichuk | 52/275 |
| 4,100,704 | 7/1978 | Oogami | 52/277 |

FOREIGN PATENT DOCUMENTS

| | | | |
|---|---|---|---|
| 547120 | 5/1956 | Belgium | 52/275 |
| 605952 | 2/1926 | France | 52/277 |
| 1184944 | 2/1959 | France | 52/275 |
| 56920 | 1/1924 | Sweden | 52/275 |
| 2029482 | 3/1980 | United Kingdom | 52/275 |

*Primary Examiner*—J. Karl Bell

*Attorney, Agent, or Firm*—Burns, Doane, Swecker & Mathis

[57] ABSTRACT

A corner block unit for a masonry retaining wall structure, comprising a pair of block members each having an inclined vertical edge portion, the block members having their respective edge portions held in contact with each other to form an inclined vertical edge of the corner block unit and being angularly spaced apart from each other about a vertical axis located at the front end of the corner block unit, rigid joint members rigidly interlocking the block members together and comprising at least one pair of rigid joint members one projecting from the inner surface of one of the block members and the other projecting from the inner surface of the other block member, each of the joint members being formed with an opening, and a bolt and a nut fastening the joint members together through the openings respectively provided in the joint members.

6 Claims, 3 Drawing Sheets

CORNER BLOCK UNIT FOR MASONRY WALL STRUCTURE

FIELD OF THE INVENTION

The present invention relates to masonry wall structures for the construction and repair of roads, bridges, canals, harbors and railways, revetments and bankings, and interior retaining walls of cellars, basements, tunnels, subway tubes and other underground and subsurface-based buildings and facilities. More particularly, the present invention relates to corner block units to form part of a masonry wall structure composed of coursed and interlocked concrete block units for use as an earth control or building wall structure.

BACKGROUND OF THE INVENTION

In order to provide ease of masonry construction work at site and to reduce the period of time required for the construction work, a masonry wall structure composed of hollow concrete blocks is in wide use typically as a retaining wall which is a wall for sustaining the pressure of earth behind the wall structure. Among such hollow concrete blocks is known a built-up type reinforced-concrete block unit which is composed of initially separate component panels. The reinforced-concrete component panels for such a built-up masonry block unit are prefabricated as separate members and are combined together into hollow block form at the site of construction.

The reinforced-concrete block units used to build a masonry wall structure such as typically a retaining wall structure are largely broken down to ordinary rectangular or parallelopiped block units laid in a number of courses and corner block units each to form the corner edge of each of the courses. While various types of hollow built-up concrete block units have thus far been proposed and put to practical use, only scarce research and development efforts have been paid to improve corner block units of the hollow built-up type.

An ordinary corner block unit for use in a retaining wall structure has a fixed corner angle and a vertical edge inclined at a fixed angle. The angle of inclination of the vertical edge of such a known corner block unit is usually selected to be proper to the angle of inclination of the corner edge of a retaining wall structure having a standard battered corner edge. The corner angle of retaining walls being different from one retaining wall structure to another, however, corner block units having fixed corner angles are relatively costly and inconvenient for use. This is primarily because of the fact that corner block units with various angle corners must be kept in stock, laid in a stock or designed and prefabricated to exactly suit the corner angles of the retaining wall structures to be constructed.

It is, accordingly, an important object of the present invention to provide an improved corner block unit having an adjustable corner angle in addition to a vertical edge inclined at a fixed angle.

In order that a corner block unit have an adjustable corner angle, the corner block unit is composed of a pair of block members which are angularly spaced apart at a desired angle about a vertical axis located at the bottom of the vertical edge of the block unit. The two block members are preferably interlocked together by suitable rigid joint members including at least one joint member secured to one of the block members and at least one joint member secured to the other block member. These at least two joint members are rigidly held together by suitable fastening means such as preferably bolts and nuts passed through openings respectively provided in the joint members.

It is, thus, another important object of the present invention to provide an improved corner block unit composed of a pair of block members which can be angularly spaced apart at a desired angle and which are interlocked together by at least one joint member secured to one of the block members and at least one joint member secured to the other block member.

It is still another important object of the present invention to provide an improved corner block unit composed of a pair of block members which are interlocked together by at least two joint members which are rigidly held together by bolts and nuts.

In order that the joint members respectively secured to the two block members be thus fastened together by means of bolts and nuts, the joint members must be bent, curved or otherwise deformed to provide a desired angle between the block members. Thus, the corner block units to be used for the construction of a retaining wall structure are, before or after they are hauled to the site of construction, set to provide a desired corner angle with the joint members of each of the corner block units bent or curved and thereafter bolted together either manually or with use of any simple, manually operated working implements. Professional skills may be required to have the joint members bent or curved to provide correct corner angles for all the corner block units to be put to use. Highly skilled techniques may also be indispensable for having the joint members bolted together while maintaining the two block members of each corner block unit in correct positions with respect to each other. If the block members of some of the corner block units have failed to be paired correctly, not only poor external appearance but insufficient structural strength of the retaining wall structure would result. The necessity for the meticulous care and possibly the large amounts of time and labor required for the bending and bolting of the joint members is objectionable from the view point of working efficiency at the site of construction or factory and for the economy of construction.

It is, therefore, still another important object of the present invention to provide an improved corner block unit composed of a pair of block members which are interlocked together by at least two joint members which can be easily and correctly held together by means of bolts and nuts without having recourse to professional skills.

SUMMARY OF THE INVENTION

In accordance with the present invention, there is provided a corner block unit comprising (a) a pair of block members each having an outer face and an inner surface portion and an inclined vertical edge portion through which the outer face and the inner surface portion meet each other, the block members having their respective edge portions held in contact with each other to form an inclined vertical edge of the corner block unit and being angularly spaced apart from each other about a vertical axis located at the bottom of the inclined vertical edge of the corner block unit, and (b) coupling means rigidly interlocking the block members together, the coupling means comprising at least one pair of rigid joint members one projecting from the inner surface portion of one of the block members and the other projecting from the inner surface portion of the other block member, each of the joint members being formed with an opening, and a bolt and a nut fastening the joint members together through the openings respectively provided in the joint members.

BRIEF DESCRIPTION OF THE DRAWINGS

The features and advantages of a corner block unit according to the present invention will be more clearly appreciated from the following description taken in conjunction with the accompanying drawings in which like reference numerals designate similar or corresponding units, members, elements and portions and in which.

DESCRIPTION OF THE PREFERRED EMBODIMENTS

Figure 1:
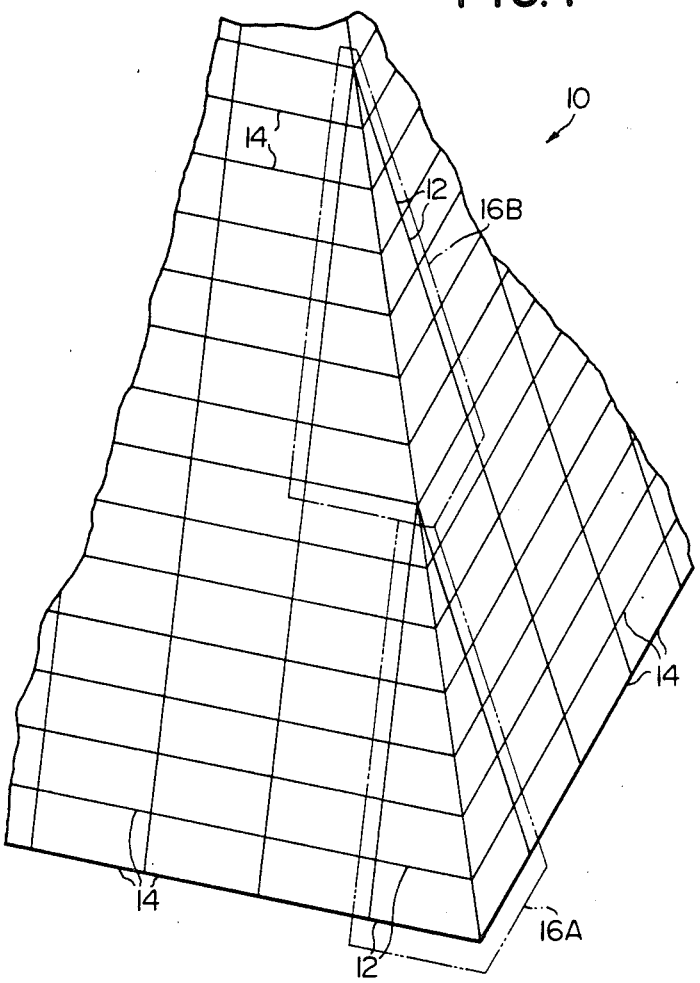
FIG. 1 is a fragmentary perspective view showing a portion of a retaining wall structure constructed by block unit including corner block units according to the present invention.

In FIG. 1 is shown a portion of a retaining wall structure 10 built with use of the corner block units proposed by the present invention. The corner block units, commonly designated by reference numeral 12, are used in combination with rectangular or parallelopiped built-in reinforced-concrete block units 14. These reinforced-concrete block units 14 are laid in a number of layers or "courses" to form two slanting or "battered" facings which define an inclined vertical corner edge at and along which the facings meet each other. Thus, the retaining wall structure 10 has along the inclined corner edge a corner portion composed of the corner block units 12 which are stacked on one another and are respectively leveled with the individual courses formed by the rectangular block units 14. The corner portion of such a retaining wall structure 10 is composed of a plurality of generally pyramidal unit sections 16A, 16B, . . . consisting of a predetermined number of element blocks which are larger in size from the largest element block at the bottom of the unit section to the smallest element block at the top of the section. The smallest element block at the top of each of the unit sections 16A, 16B, . . . forms a pinnacle member of the unit section and may be formed by casting mortal or cement after the remaining element blocks of the section have been laid in position. Thus, the element blocks forming each of the unit sections 16A, 16B, . . . are provided by the corner block units 12 except for the uppermost element block forming the pinnacle member. FIGS. 2 to 5 of the drawings show some preferred embodiments of the corner block units 12 thus forming part of each of the unit sections 16A, 16B, . . . of the retaining wall structure 10.

Figure 2:
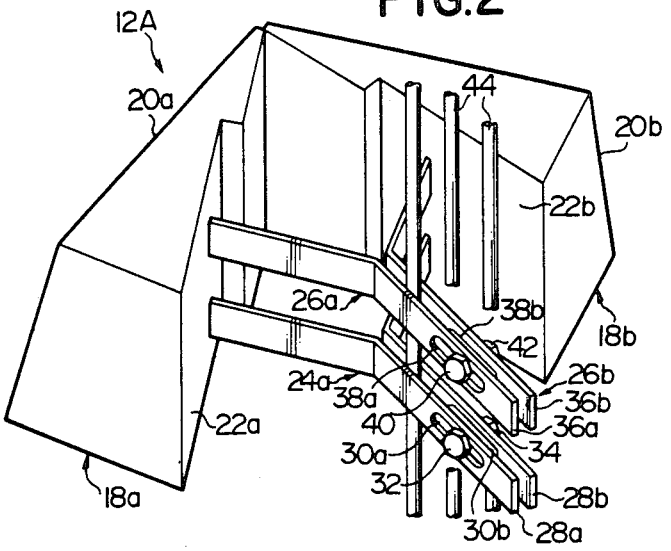
FIGS. 2, 3 and 4 are perspective views of first, second and third preferred embodiments, respectively, of a corner block unit according to the present invention.

Referring to FIG. 2, a first preferred embodiment of a corner block unit according to the present invention, designated in its entirety by 12A, comprises a pair of block members **18*a* and 18*b* of, typically, portland cement concrete. The block members 18*a* and 18*b* have vertically slanting outer faces 20*a* and 20*b* which are to form part of the battered facings of a retaining wall structure and vertical inner surface portions 22*a* and 22*b* terminating at the rear ends of the block members 18*a* and 18*b*, respectively. Each of the block members 18 and 18*b* further has an inclined front edge portion through which the outer face 20*a*/20*b* and inner surface portion 22*a*/22*b* of each block member meet each other. The block members 18*a* and 18*b* have their respective front edge portions held in contact with each other to form an inclined vertical edge to form part of the inclined vertical corner edge of the retaining wall structure. The block members 18*a* and 18, or the respective inner surface portions 22*a* and 22*b* of the block members 18*a* and 18*b*, are angularly spaced apart from each other about a vertical axis located at the front end of the corner block unit 12A, viz., at the bottom of the inclined vertical edge of the corner block unit 12A**.

The corner block unit 12A embodying the present invention further comprises coupling means rigidly interlocking the block members **18*a* and 18*b* together and implemented by at least one pair of rigid joint members. In the embodiment herein shown, such coupling means comprises a pair of lower steel straps 24*a* and 24*b* and a pair of upper steel straps 26*a* and 26*b*, each of the lower and upper steel straps 24*a* and 26*a* projecting from the inner surface portion 22*a* of the block member 18*a* and each of the lower and upper steel straps 24*b* and 26*b* projecting from the inner surface portion 22*b* of the block member 18*b***.

The steel straps **24*a* and 24*b* horizontally extend toward each other from the block members 18*a* and 18*b*, respectively, and have outwardly bent or curved arm portions 28*a* and 28*b* formed with openings 30*a* and 30*b*, respectively. These arm portions 28*a* and 28*b* of the steel straps 24*a* and 24*b* overlap with each other and horizontally extend straight away from the vertical axis at the front end of the corner block unit 12A so that the openings 30*a* and 30*b* are largely aligned horizontally with each other. The steel straps 24*a* and 24*b* are rigidly fastened together by means of a bolt 32 and a nut 34 through the openings 30*a* and 30*b* in the straps 24*a* and 24*b***, respectively.

Likewise, the steel straps **26*a* and 26*b* horizontally project toward each other from the block members 18*a* and 18*b*, respectively, and have outwardly bent or curved arm portions 36*a* and 36*b* formed with openings 38*a* and 38*b*, respectively. These arm portions 36*a* and 36*b* of the steel straps 26*a* and 26*b* also overlap with each other and horizontally extend straight away from the vertical axis at the front end of the corner block unit 12A so that the openings 38*a* and 38*b* are largely aligned horizontally with each other. The steel straps 26*a* and 26*b* are rigidly fastened together by means of a bolt 40 and a nut 42 through the openings 38*a* and 38*b* in the straps 26*a* and 26*b***, respectively.

As illustrated, the opening formed in each of the steel straps **24*a*, 24*b*, 26*a* and 26*b* is provided preferably in the form of a slot horizontally elongated away from the vertical axis, viz., in a direction in which the steel strap formed with the particular opening extends. The bolts 32 and 40 and nuts 34 and 42 also form part of the coupling means of the corner block unit 12A embodying the present invention. If desired, the paired steel straps 24a and 24b and paired steel straps 26a and 26b may be fastened together with a suitable number of vertical reinforcing steel rods or bars 44 passed through the paired steel straps as shown. These reinforcing steel bars 44 are closely interposed between the arm portions 28a and 28b of the paired steel straps 24a and 24b and the arm portions 36a and 36b of the paired steel straps 26a and 26b so that the arm portions of each pair of steel straps are radially spaced apart from each other. These reinforcing bars 44 may vertically extend throughout all the element blocks of the pyramidal unit section which the corner block unit 12A** forms part of, though not shown in the drawings.

Figure 3:
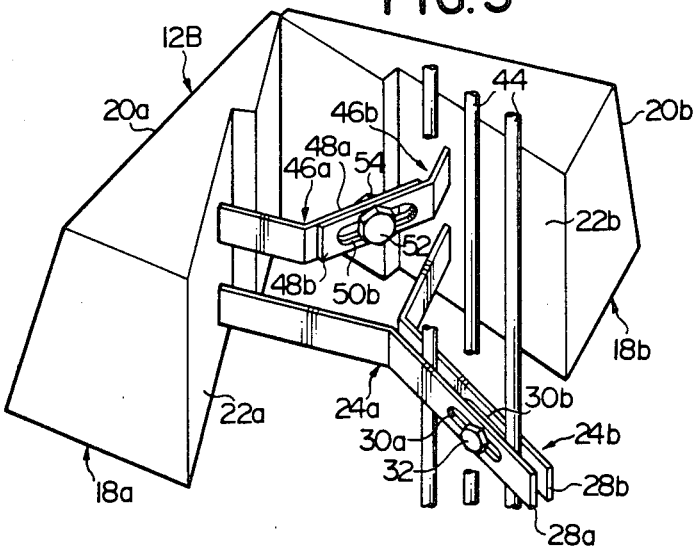

The coupling means provided in the corner block unit 12A is effective to resist a force which may urge the block members 18a and 18b of the unit angularly away from each other about the vertical axis at the front end of the corner block unit 12A. The coupling means is thus useful for precluding the block members 18a and 18b from being turned with respect to each other about the front end of the corner block unit 12A against an earth pressure to act on the corner block unit. FIG. 3 shows a corner block unit 12B which has coupling means which is effective not only similarly to such coupling means of the corner block unit 12A but also for preventing the block members 18a and 18b from being moved forwardly or rearwardly with respect to each other.

Referring to FIG. 3, such dual-effect coupling means comprises a pair of inwardly bent or curved upper steel straps 46a and 46b in addition to the outwardly bent or curved lower steel straps 24a and 24b similar to their counterparts in the corner block unit 12A. These inwardly bent or curved upper steel straps 46a and 46b horizontally project toward each other respectively from the block members 18a and 18b and have arm portions 48a and 48b each formed with an opening such as the opening 50b shown formed in the steel strap 46b. The respective arm portions 48a and 48b of the steel straps 46a and 46b overlap with each other and horizontally extend straight toward the respective inner surface portions 22b and 22a of the opposite block members 18b and 18a. The opening formed in each of the steel straps 46a and 46b is also preferably in the form of a slot horizontally elongated in a direction in which the arm portion of the steel strap formed with the opening extends.

The steel straps 46a and 46b are rigidly fastened together by means of a bolt 52 and a nut 54 through the openings in the arm portions 48a and 48b of the straps 24a and 24b, respectively. Though not shown, the steel straps 46a and 46b may be fastened together with a reinforcing steel bar or bars interposed between the respective arm portions 48a and 48b thereof.

Figure 4:
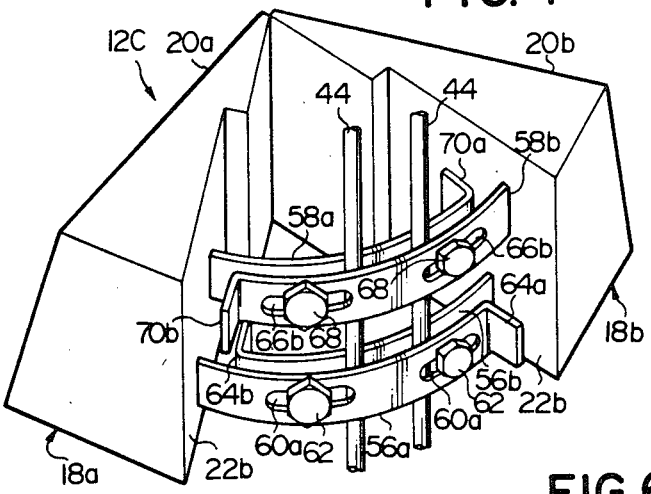

Turning to FIG. 4, the coupling means of the corner block unit, now denoted by 12C, implementing a third preferred embodiment of the present invention comprises a pair of curved lower outer and inner steel straps 56a and 56b and a pair of curved upper inner and outer steel straps 58a and 58b. Each of the lower outer steel strap 56a and upper inner steel strap 58a projects horizontally from the inner surface portion 22a of the block member 18a and each of the lower inner steel strap 56b and upper outer steel strap 58b projects horizontally from the inner surface portion 22b of the block member 18b. The paired lower steel straps 56a and 56b and the paired upper steel straps 58a and 58b have curved portions horizontally curved arcuately about the vertical axis at the front end of the corner block unit 12C toward the respective inner surface portions 22b and 22a of the opposite block members 18b and 18a, respectively. The curved portions of the steel straps 56a and 56b overlap with each other about the front end of the corner block unit 12C and are formed with openings such as the opening 60a shown formed in the steel strap 56a. The steel straps 56a and 56b are rigidly fastened together by means of a bolt 62 and a nut (not shown) through the openings in the curved portions of the straps 56a and 56b, respectively. If desired, the steel straps 56a and 56b may have their leading end portions 64a and 64b radially bent before reaching the inner surface portions 22b and 22a of the opposite block members 18b and 18a, respectively as shown. Similarly, the curved portions of the steel straps 58a and 58b overlap with each other about the front end of the corner block unit 12C and are formed with openings such as the opening 66b shown formed in the steel strap 58b. The steel straps 58a and 58b are also rigidly fastened together by means of a bolt 68 and a nut (not shown) through the openings in the curved portions of the straps 58a and 58b, respectively. The steel straps 58a and 58b may also have their leading end portions 70a and 70b radially bent before reaching the inner surface portions 22b and 22a of the opposite block members 18b and 18a, respectively. The opening formed in each of the steel straps 56a, 56b, 58a and 58b is also preferably in the form of a slot horizontally elongated in a direction in which the curved portion of the steel strap formed with the opening extends. The steel straps 56a and 56b and steel straps 58a and 58b may also be fastened together with a suitable number of reinforcing steel bars 44 interposed between the respective curved portions thereof, as illustrated.

Figure 6:
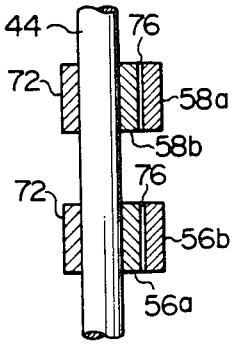
FIG. 6 is a vertical sectional view of the assembly of the joint members, or steel straps, which form part of the corner block unit shown in FIG. 5.
Figure 7:
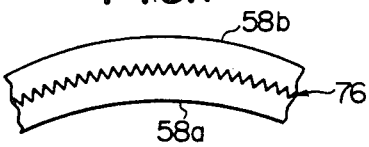
FIG. 7 is a top plan view showing, to an enlarged scale, portions of two joint members, or steel straps, fastened together in the corner block unit shown in FIG. 5.

Alternatively, the curved portions of the paired steel straps 56a and 56b and the curved portions of the paired steel straps 58a and 58b may be closely attached to each other as in the corner block unit 12D forming a fourth preferred embodiment of the present invention. In this case, each of the curved portions of the paired steel straps such as of the steel straps 58a and 58b may have toothed, serrated or knurled surface portions which are held in mating engagement with each other as indicated at FIGS. 6 and 7.

Figure 5:
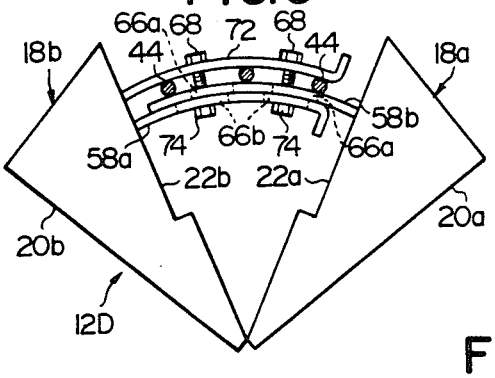
FIG. 5 is a top plan view of a fourth preferred embodiments of a corner block unit according to the present invention.

In the embodiment of FIG. 5, there are provided a pair of additional steel straps one associated with the paired steel straps 56a and 56b and the other associated with the paired steel straps 58a and 58b as indicated at 72. Each of these additional steel straps such as the steel strap 72 horizontally projects from one of the block members such as the block member 18b toward the other block member as shown and has a curved portion overlapping with and radially spaced apart from the curved portion of the outer steel strap 56b. The curved portion of the steel strap 72 is also formed with an opening (not shown) and is rigidly coupled to the associated steel straps 58a and 58b by means of the bolt 68 and nut 74 through the respective openings 66a and 66b in the steel straps and the opening in the additional steel strap. A suitable number of vertical steel bars 44 are closely interposed between the curved portion of the steel strap 58b and the curved portion of the additional steel strap 72 as shown. While the additional steel straps are assumed to be provided radially outwardly of the steel straps 56a, 56b, 58a and 58b in the embodiment shown in FIG. 5, the former may be provided radially inwardly of the latter, though not shown.

What is claimed is:

1. A corner block unit comprising (a) a pair of block members each having an outer face and an inner surface portion and an inclined vertical edge portion through which said outer face and said inner surface portion meet each other, said block members having their respective edge portions held in contact with each other to form an inclined vertical edge of the corner block unit and being angularly spaced apart from each other about a vertical axis located at the bottom of said inclined vertical edge of the corner block unit, and (b) coupling means rigidly interlocking said block members together, said coupling means comprising at least one pair of rigid joint members one projecting from the inner surface portion of one of said block members and the other projecting from the inner surface portion of the other block member, each of said joint members being formed with an opening, and a bolt and a nut fastening said joint members together through the openings respectively provided in the joint members.

2. A corner block unit as set forth in claim 1, in which said rigid joint members horizontally project toward each other respectively from said block members and have respective arm portions each formed with said opening, the respective arm portions of the joint members overlapping with each other and horizontally extending substantially straight away from said vertical axis, the opening in each of said joint members being horizontally elongated away from said vertical axis.

3. A corner block unit as set forth in claim 1, in which said rigid joint members horizontally project toward each other respectively from said block members and have respective arm portions each formed with said opening, the respective arm portions of the joint members overlapping with each other and horizontally extending substantially straight toward the respective inner surface portions of the opposite block members, the opening in each of said joint members being horizontally elongated in a direction in which the arm portion of the joint member formed with the opening extends.

4. A corner block unit as set forth in claim 1, in which said rigid joint members horizontally project toward each other respectively from said block members and have respective curved portions each formed with said opening, the respective curved portions of the joint members overlapping with each other about said vertical axis and horizontally curved arcuately about said vertical axis toward the respective inner surface portions of the opposite block members, the opening in each of said joint members being horizontally elongated in a direction in which the curved portion of the joint member formed with the opening extends.

5. A corner block unit as set forth in claim 4, in which said joint members have toothed surface portions which are held in mating engagement with each other.

6. A corner block unit as set forth in claim 5, in which said coupling means further comprise a third joint member horizontally projecting from one of said block members toward the other block member and having a curved portion formed with an opening, the curved portion of the third joint member at least in part overlapping with the curved portion of one of said two joint members, said two joint members and said third joint member being rigidly coupled together by means of said bolt and nut through the respective openings in said two joint members and the opening in said third joint member with at least one vertically extending steel bar closely interposed between the curved portion of said one of the two joint members and the curved portion of said third joint member.

* * * * *